US008424983B1

(12) United States Patent
Strauss et al.

(10) Patent No.: US 8,424,983 B1
(45) Date of Patent: Apr. 23, 2013

(54) MOTORIZED UPPER AND LOWER STORAGE SHELVES

(76) Inventors: Gary Strauss, Poughquag, NY (US); Elisa Strauss, Poughquag, NY (US)

( * ) Notice: Subject to any disclaimer, the term of this patent is extended or adjusted under 35 U.S.C. 154(b) by 0 days.

(21) Appl. No.: 13/370,547

(22) Filed: Feb. 10, 2012

(51) Int. Cl.
*A47B 96/00* (2006.01)

(52) U.S. Cl.
USPC ..... 312/247; 312/310

(58) Field of Classification Search ..... 312/245, 312/246, 247, 294, 298, 301, 310, 312, 319.5, 312/319.7, 319.8; 414/277, 281, 282, 331.14
See application file for complete search history.

(56) References Cited

U.S. PATENT DOCUMENTS

| | | | | |
|---|---|---|---|---|
| 2,382,354 | A * | 8/1945 | Wales | 312/247 |
| 2,579,876 | A * | 12/1951 | Stebbins | 312/319.7 |
| 3,224,827 | A * | 12/1965 | Foster et al. | 312/266 |
| 3,415,586 | A * | 12/1968 | Hammond | 312/312 |
| 4,915,461 | A | 4/1990 | Kingsborough et al. | |
| 5,076,649 | A | 12/1991 | Therkelsen | |
| 5,228,763 | A | 7/1993 | Gingold | |
| 5,249,858 | A | 10/1993 | Nusser | |
| 5,586,816 | A * | 12/1996 | Geiss, II | 312/301 |
| 6,367,898 | B1 | 4/2002 | Jobe | |
| 6,484,893 | B1 * | 11/2002 | Tkatch | 211/94.02 |
| 6,755,492 | B1 * | 6/2004 | Hyde et al. | 312/247 |
| 7,621,605 | B2 | 11/2009 | Bond et al. | |
| 7,770,986 | B1 * | 8/2010 | Simaitis | 312/247 |
| 7,794,027 | B2 | 9/2010 | Calabria et al. | |
| 2007/0025830 | A1 * | 2/2007 | Solomon et al. | 414/277 |
| 2011/0266936 | A1 | 11/2011 | Moran | |

OTHER PUBLICATIONS

"What the Universal Design AUTO-CAB Cabinet Gives You," Features of the Universal Design AUTO-CAB Cabinet, found: http://www.automatedcabinetsystems.com/features.htm, Nov. 4, 2011, 3 pgs.

"Accessible Kitchens: Wallcabinet Lift—VERTI," Accessibility Professionals—Accessible Kitchens—Wallcabinet Lifts, found: http://www.handicapped-accessible-kitchens.com/automatic_shelvin . . . Nov. 1, 2011, 4 pgs.

* cited by examiner

*Primary Examiner* — James O Hansen
(74) *Attorney, Agent, or Firm* — Saile Ackerman LLC; Stephen B. Ackerman

(57) ABSTRACT

A storage VBS with opposing side walls, a top, a bottom, a back with an open or openable front, houses moveable upper and lower adjustable shelving boxes. The shelving boxes are moveably motorized and controlled sequentially. An upper shelf is made accessible by driving an upper shelving box out of the VBS and then adjusting the shelf height for storage or retrieval of an item. The upper shelving box must be returned to the VBS prior to operating the lower shelving.

5 Claims, 11 Drawing Sheets

MOTORIZED UPPER AND LOWER STORAGE SHELVES

TECHNICAL FIELD

This disclosure relates to motorized shelving, to move the shelving and items contained therein to different heights, to, for example, meet the special needs of the physically challenged, or those who are otherwise healthy and productive having limited reaching and kneeling abilities.

BACKGROUND

Conventional storage cabinets, particularly of the kitchen wall mounted type, are not ergonomically convenient to certain groups of people; moreover, most top shelves are too high and out of reach for the average person. Consequently, people in wheel chairs, for example, otherwise capable of performing normal activities, may be unable to reach items stored in any of the cabinet shelves. Similarly, the ability to reach or to kneel can be difficult for some in the elderly populace, those with disabilities or physical ailments and for individuals of less than average height.

A number of storage cabinets have been created that allow access to shelves that are difficult to reach. Bond et al, (U.S. Pat. No. 7,621,605) discloses a cabinet which drives a basket or shelf forward and then lifts it upward using a motor driven linear actuator or pulleys rotated by drive cords of belts. Jobe, (U.S. Pat. No. 6,367,898) shows a cabinet assembly which moves reversibly along a track on roller guide bearings, down and out away from a wall, and which can be moved by a motorized hoist. Kingsborough et al (U.S. Pat. No. 4,915,461) describes a storage device for cabinets having shelves carried by pairs of spaced, pivotally mounted arms. The arms are adapted to swing outwardly and downwardly, with the shelves maintaining a substantially horizontal attitude. A power unit extends and retracts a flexible cord to move the assembly.

Several other U.S. Patents have been found, most however, are based upon assemblies that can be unsafe. From the above-mentioned related art, it is apparent that there continues to be a need for reachable cabinet assemblies which are strong and safe.

SUMMARY

The present disclosure teaches certain benefits in construction and use which give rise to the objectives described below. The disclosure connects to, for example, the special needs of the physically challenged, and to otherwise healthy and productive elders, or others, who may have difficulty reaching items on shelves. The design approach for reachable shelving in kitchen cabinets, or for tools in a garage, manufacturing parts for assembly, office file documents, or any business requiring storage, and other applications, is to provide a stable and adjustable cabinet that is designed for individuals who use wheelchairs or who cannot reach for items stored on shelves that are above or below their reaching comfort zone. This motorized wall cabinet adjustment system uses a powered push button system to lower and raise cabinet shelves.

A primary objective of the present disclosure is to provide reachable shelves for the physically challenged.

Another objective of the present disclosure is to provide a product with motorized shelving units for storage and retrieval, as for example, items in a kitchen, tools in a garage, manufacturing parts for assembly, office file documents, or any business requiring storage.

Yet another objective of the present disclosure is to provide an improved cabinet such that the upper shelving and lower shelving units are separately moved out of the cabinet and vertically adjusted by the by an individual for storage or retrieval of articles placed therein, or removed therefrom.

Still another objective of the present disclosure is to provide a safe operating sequence wherein both shelving units must in the cabinet before moving a particular shelving unit out of the cabinet.

A further object of the present disclosure is to provide a mechanized and electrified cabinet using "off the shelf" mechanical and electrical components Other features and advantages of the embodiment of the present disclosure will become apparent from the following more detailed description, taken in conjunction with the accompanying drawings.

The above objects are achieved by: A vertical box system comprising: a vertical box structure; an upper motorized platform, and a lower motorized platform; the upper and lower motorized platforms horizontally and separately moves an upper shelving box or a lower shelving box from inside of the vertical box structure to an outside position; the upper and lower shelving boxes are positioned with an open front and at least one shelf; the upper motorized platform is activated only if the lower motorized platform is sensed as being inside the vertical box; the upper and lower shelving boxes are separately and vertically adjusted while in the outside position; the adjusted means is controlled with a push button.

An upper vertical box system comprising: a vertical box structure; a motorized platform; the motorized platforms horizontally moves a shelving box from inside of the upper vertical box structure to an outside position; the shelving box is positioned with an open front and at least one shelf; the shelving box is vertically adjusted while in the outside position; the adjusted means is controlled with a push button.

A lower vertical box system comprising: a vertical box structure; a motorized platform; the motorized platforms horizontally moves a shelving box from inside of the vertical box structure to an outside position; the shelving box is positioned with an open front and at least one shelf; the shelving box is vertically adjusted while in said outside position; the adjusted means is controlled with a push button.

DETAILED DESCRIPTION

This disclosure teaches certain benefits in construction and use which give rise to the detailed description below. This disclosure relates to, for example, the special needs of the physically challenged, as well as to healthy and productive elders, or others, having reaching difficulties. The design approach for reachable shelving in kitchen cabinets is to provide a stable and adjustable walled shelving unit designed for individuals who use wheelchairs or cannot reach for items stored above or below their reaching comfort zone. This motorized shelving adjustment system uses a powered push button system in concert with sensors to safely lower and raise walled shelving units.

Related cabinet apparatuses with moving shelves fail to provide means to adjust from an upward unreachable position to a lower retrieval position and/or, from a lower unreachable position to an upward retrieval position.

Referring to drawings, FIGS. 1*a*-1*d*, illustrating perspective views of a vertical box structure 100 (hereafter referred to as VBS), constructed of wood, metal, or other materials having applicable strength. The present disclosure can be constructed inside an existing kitchen cabinet, or for any other shelving needs for which moveable shelves would be desired, as for example, garages, basements, workshops, hospitals, warehouses, or within an industrial setting such as a manufacturing assembly area. Structural design and materials would be tailored for a specific application.

Figure 3:
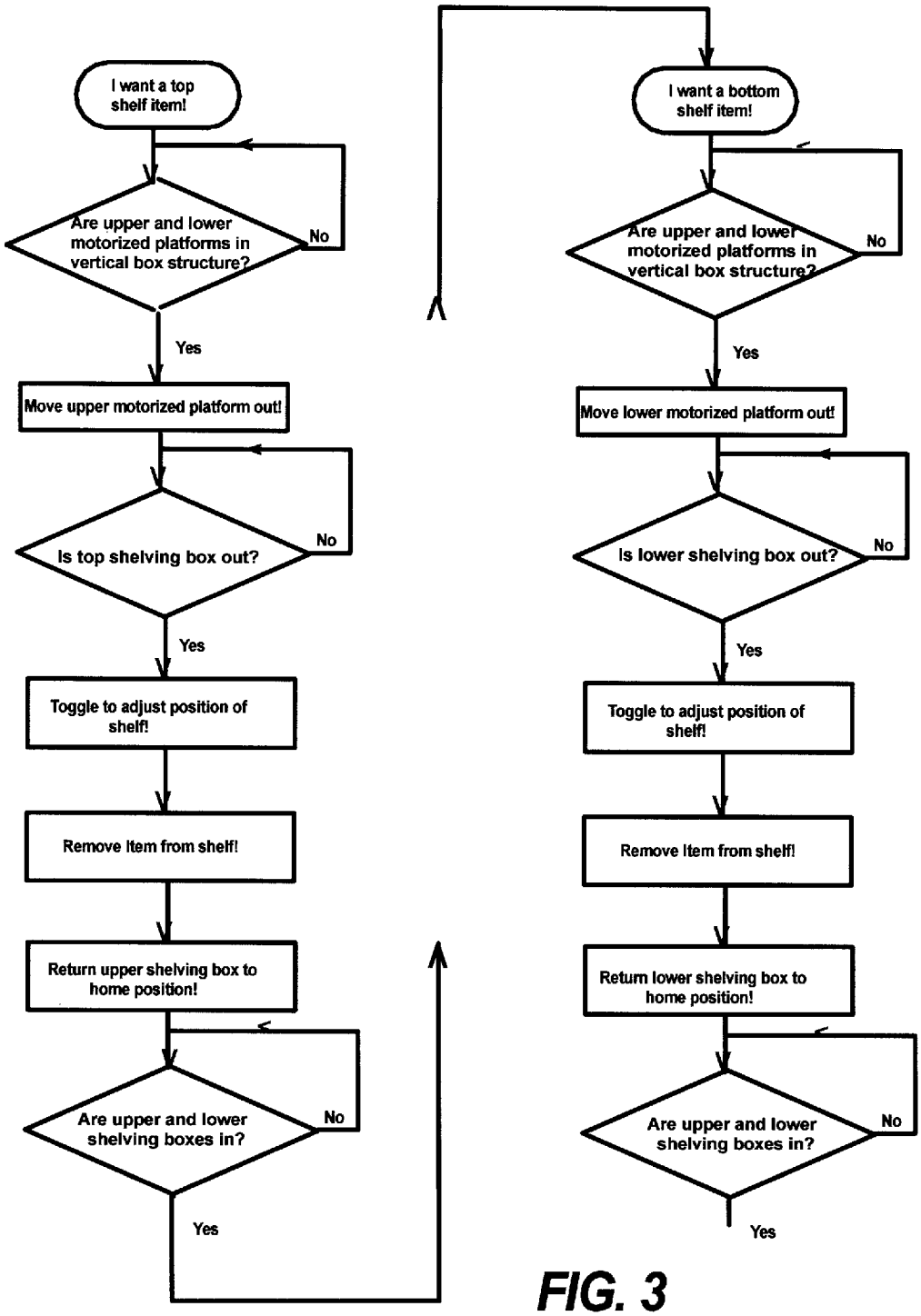
FIG. 3 is a flow chart demonstrating the manner in which the sensor based system controls the safety aspect of the shelving box movements of the present disclosure.
Figure 3A:
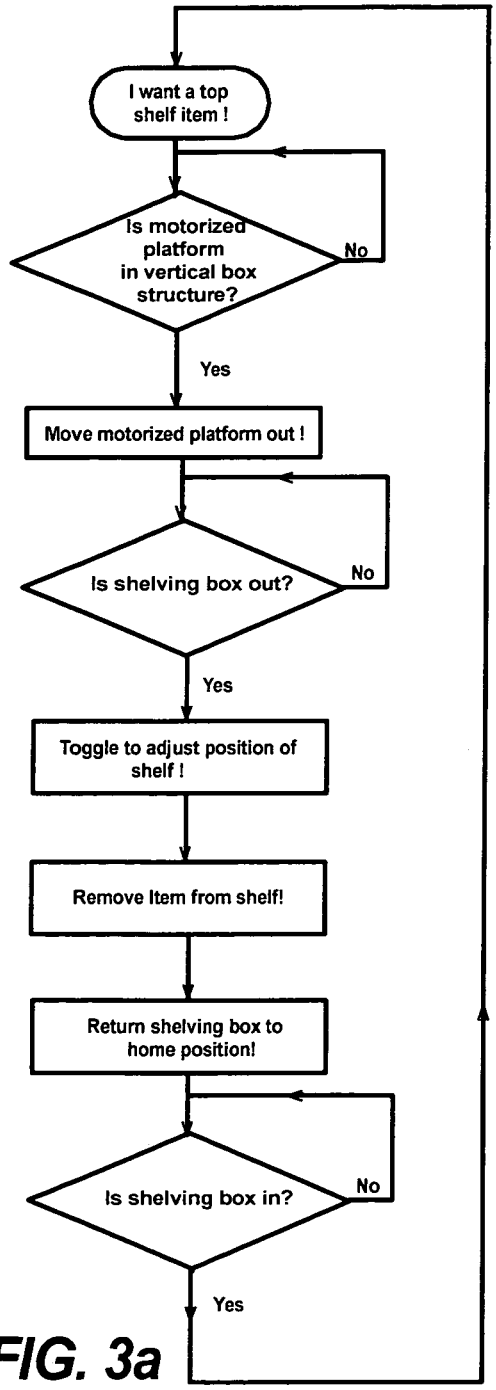
FIG. 3*a* is a flow chart demonstrating the manner in which the sensor based system safely controls the horizontal and vertical movement of the upper box structure of the present disclosure.

The illustrative views in FIGS. 1*a*-1*d*, point out various operation modes showing movability of an upper motorized platform 110, adjustability of an upper shelving box 101, movability of a lower motorized platform 130 and adjustability of a lower shelving box 102. FIGS. 1*b*, 1*d*, 6, 7, 8, 9, 11 and 12 show horizontal and vertical extendibility for both upper and lower motorized platforms. FIG. 3 is a flow chart describing the "go, no-go" controls, wherein limit switches are either open or closed managing both upper and lower movements of the motorized platforms and adjustability of the shelving boxes.

Figure 10:
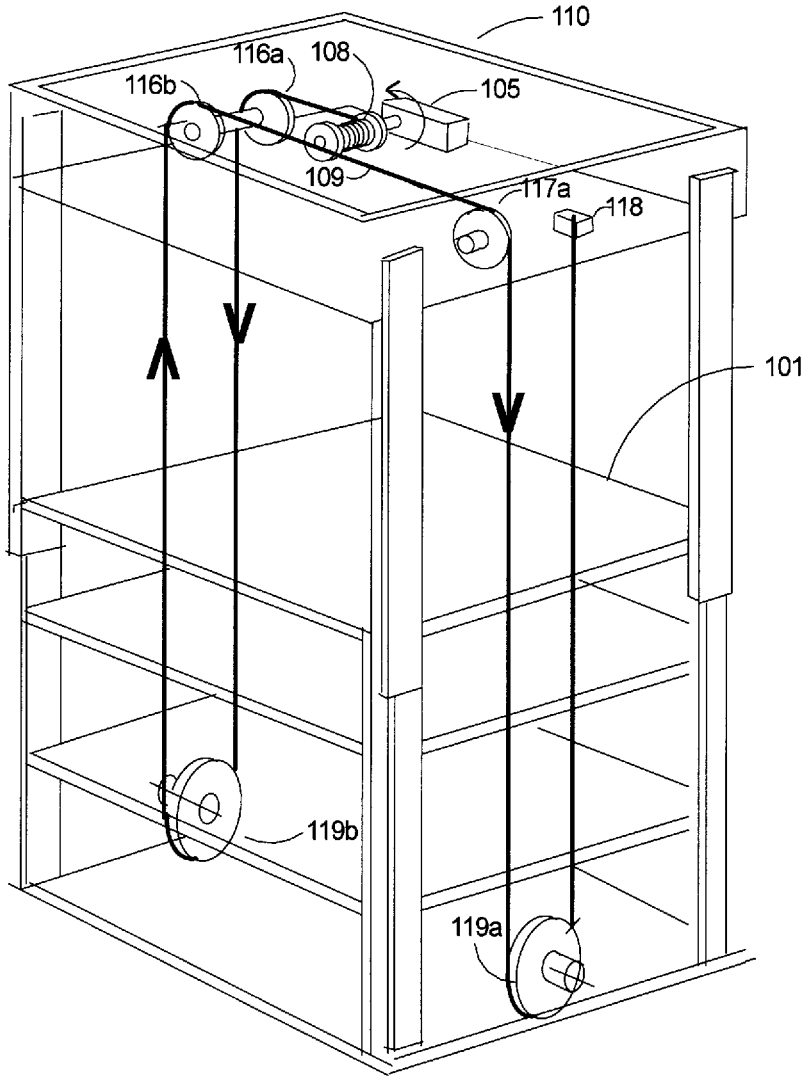
FIG. 10 shows a schematic of the cable system used for lowering and raising the upper shelving box of the present disclosure.

FIGS. 2*a*-2*i* illustrate side views of the vertical box system showing the VBS 100 and the horizontal and vertical controlled interchange of the shelving boxes 101 and 102. FIGS. 2*b*-2*e* show moving action of the upper horizontal slides 111*a*, 111*b* and vertical slides 113*a*, 114*a*. A more detailed description of the linear actuators used for moving the upper motorized platform and the upper shelving box will be described later with reference to FIGS. 4 and 10.

Figure 1A:
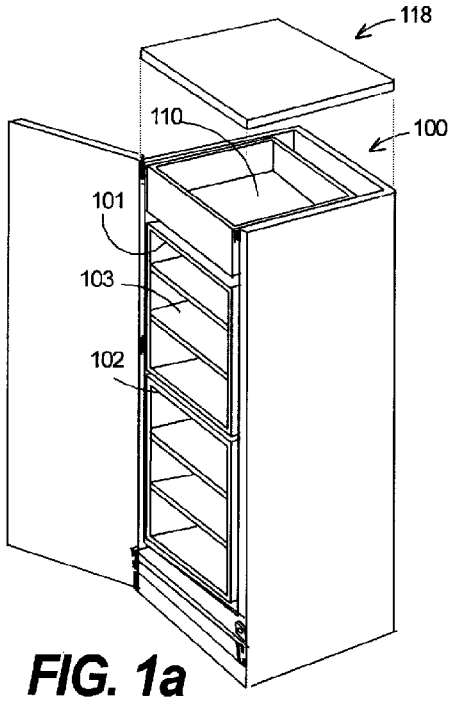
FIGS. 1*a*-1*d* are perspective views, of the present disclosure, illustrating the upper shelving box and lower shelving box extended out from the VBS and retracted back into the VBS.

FIG. 1*a* shows the VBS 100 having a top (lifted away), a bottom, an optional door, two sides and a back. The VBS houses a horizontally slideable upper motorized platform 110, upper shelving box 101, lower shelving box 102 and a horizontally slideable lower utility compartment 130.

Figure 1B:
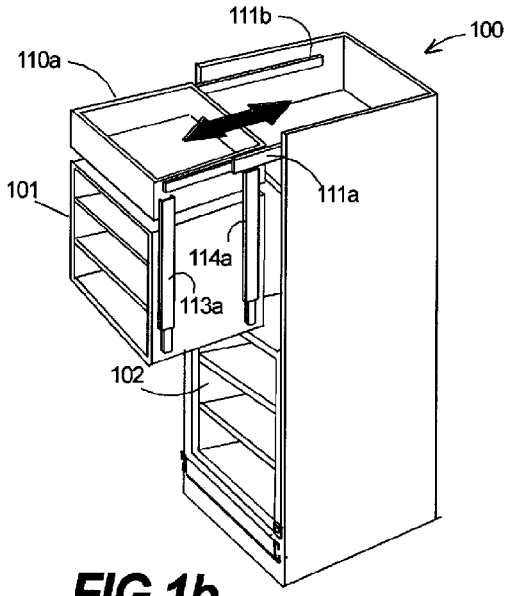
Figure 6:
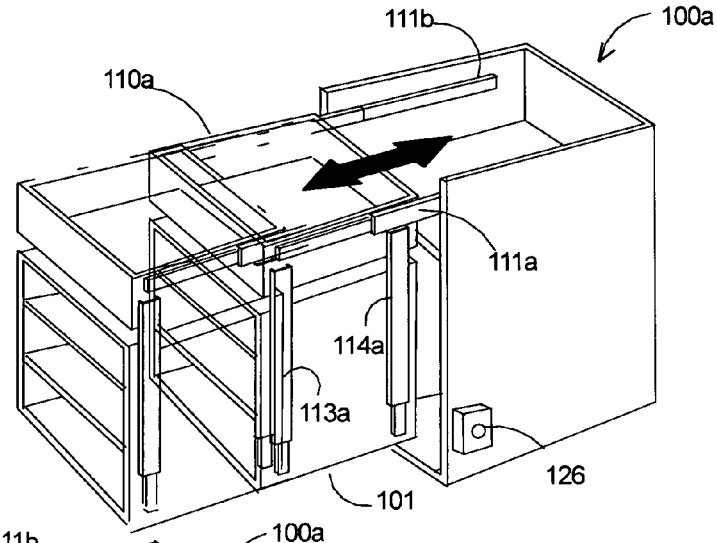
FIGS. 6 and 7 shows an elevated box embodiment, of the present disclosure, mountable over a counter top showing a horizontal extended shelving box and a vertically lowered shelving box.

FIGS. 1*b* and 6 illustrate a reversibly moveable upper motorized platform 110 having four sides and a bottom surface. The upper motorized platform is shown horizontally extended, carries the upper shelving box 101 out of the VBS to a vertically adjustable position. The upper motorized platform is slidably fastened to horizontally mounted ball slides 111*a* and 111*b*. The ball slides are fastened to the upper and inner side surfaces of VBS 100. The upper shelving box is secured to the outer side corners of the utility compartment with vertically mounted ball slides 113*a* and 114*a* shown on the near side ball slides. Ball slides 113*b*, 114*b* are not visible from the far side. The mechanisms packaged within the upper motorized platform are shown in FIG. 4, containing drives for reversibly moving the motorized platform and the upper shelving box.

Figure 1C:
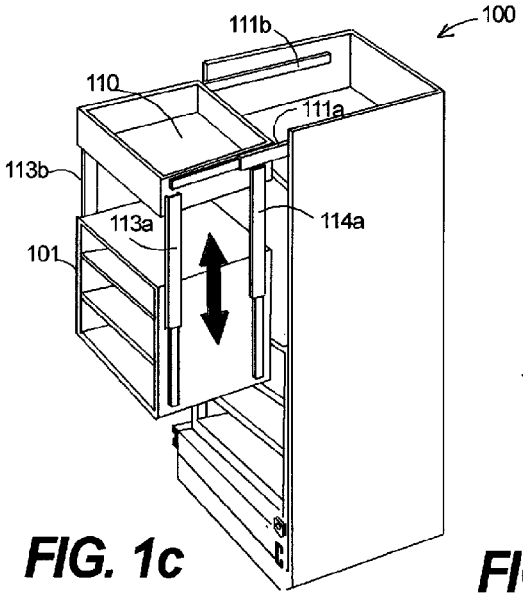
Figure 7:
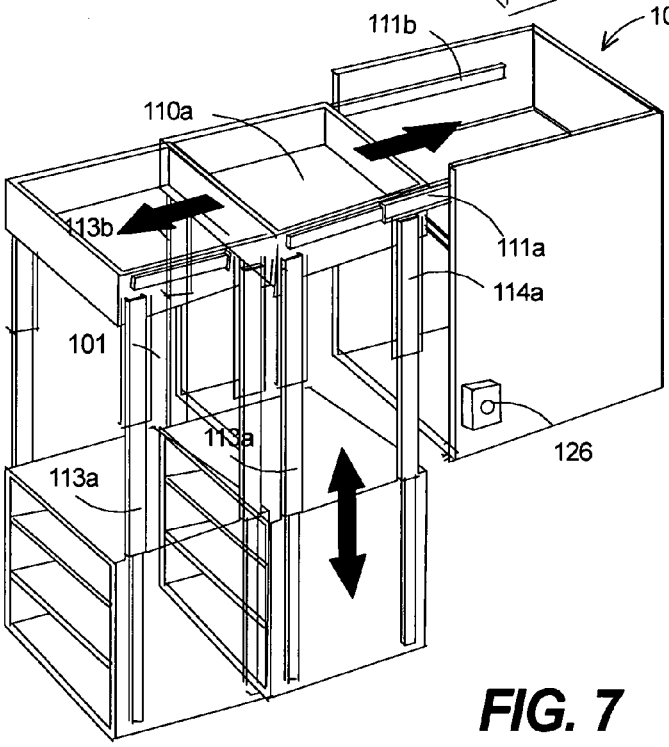
Figure 8:
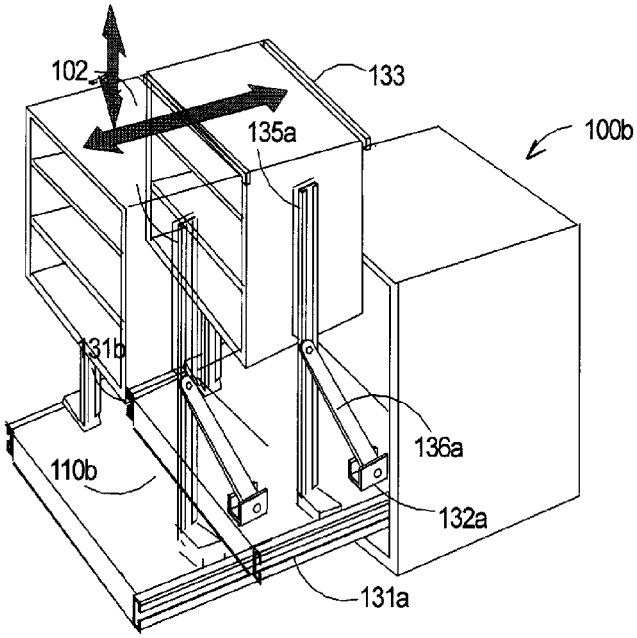
FIGS. 8 and 9 show a lower box embodiment, of the present disclosure, mountable under a counter top showing a horizontal extended shelving box and a vertically raised shelving box.
Figure 9:
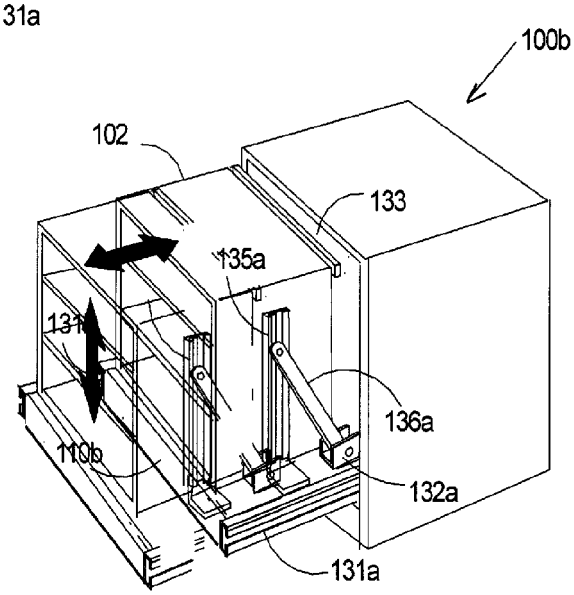

FIG. 1*c* and FIG. 7 show the VBS with the motorized platform 110 fully extended and securely supported with ball slides 111*a* and 111*b*. The upper shelving box 101 is shown extended vertically with four ball slides 113*a*, 113*b*, 114*a* and 114*b*, mounted to each corner of the upper shelving box and secured to corresponding corners of the upper shelving box. Ball slide 113*b* is shown in FIG. 1*c*. Ball slide 114*b*, not shown, is located in the hidden corner. Vertical positioning for shelf access is controlled by a person wanting reachable access to an item stored or to be stored on a particular shelf.

Figure 4:
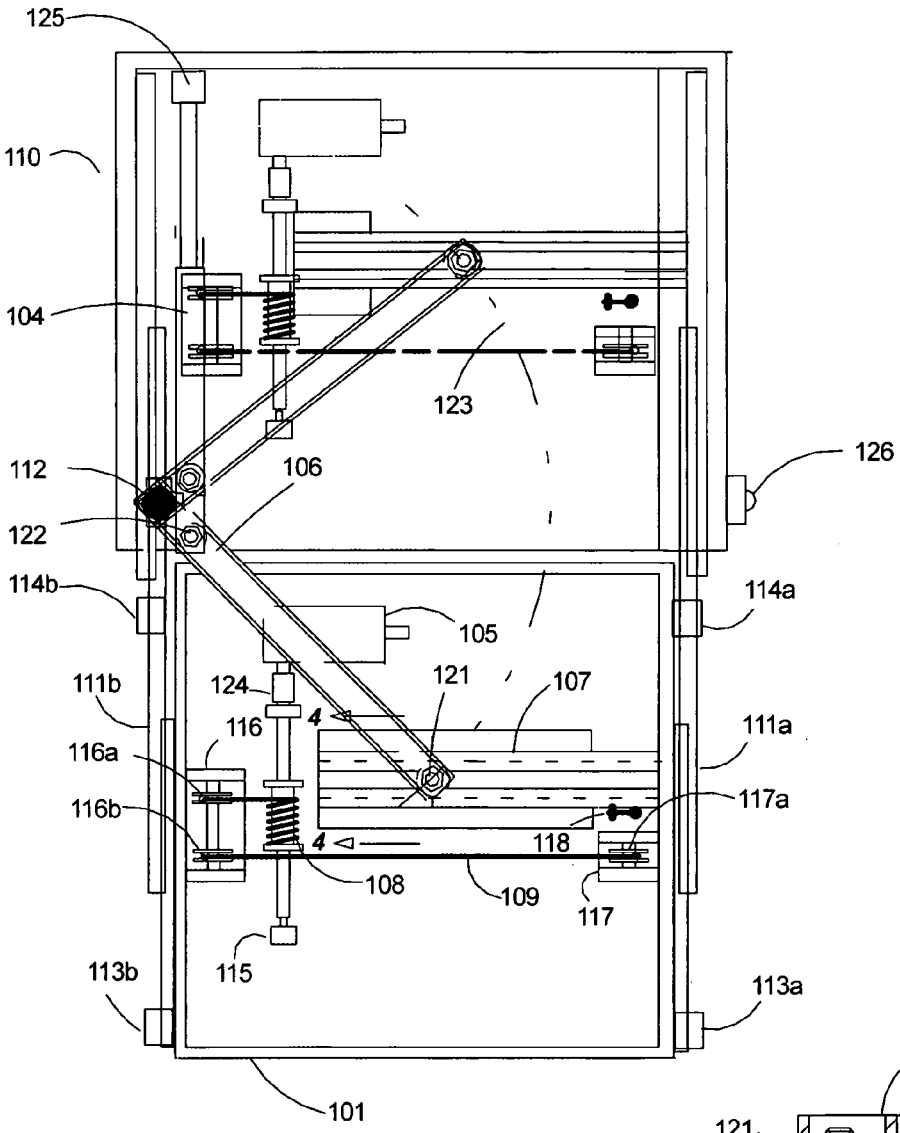
FIG. 4 is an illustration showing a top view and a cross-sectional view of the mechanisms for extending and retracting the shelving box for both the horizontal and vertical movements.
Figure 4A:
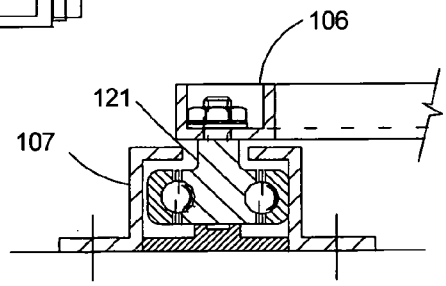
FIG. 4*a* shows an enlarged cross-sectional view of the upright channels and radial bearing used for horizontally extending and retracting the shelving box of the present disclosure.

Referring now to FIGS. 4 and 4*a* showing the mechanized and electrified components that move the upper motorized platform 110 and the upper shelving box 102. As previously described, the mounting of the horizontal ball slides 111*a* and 111*b* and the four vertical ball slides 113*a*, 113*b*, 114*a* and 114*b* are also graphically shown. A linear actuator 104 is used to reversibly move the upper motorized platform and the attached upper shelving box out of the VBS confines and back into the VBS. The stationary part 125 of the linear actuator is mounted to the top surface of the upper VBS member. The moveable end of the linear actuator 104 having a radial bearing 122 placed in an upright "U" channel 106. The "U" channel is pivotally mounted 112 at the bottom surface on one end. A roller bearing 121 is mounted on the underside of the upright "U" channel at the other end. The roller bearing 121 rides in an upright channel 107, shown in FIG. 4*b*, formed by two face to face positioned "Z" shaped members using an inner side to bear against when pushing the shelving box out of the VBS and the other inner side of the "U" channel to bear against when pulling the shelving box back in. Push button controls 126 for vertical adjustment as shown in FIG. 7.

After the upper motorized platform and upper shelving box are moved out of the VBS (refer also to FIG. 10), a geared motor 105 rotates coupling 124 connecting a shaft spooling member 108 such to reversibly lower and to raise the shelving box 101 using a cable and pulley combination. Cable 109 is routed as follows: A first cable end 118 is fastened to the bottom member of the motorized platform passing downwards through a hole looping around a pulley 119*a*, connected to the shelving box shown in FIG. 10, and back up and around pulley 117*a* supported by member 117, to a pulley 116*b*, located on the opposite side, and threaded down thru a hole in the bottom of the motorized platform and looped around a second pulley 119*b* connected to the opposite side of the shelving box 101, and back through a hole under pulley 116*a* and around pulley 116*a* and fastened to spooling member 108 to wind or unwind the cable by a motor 105, thusly raising or lowering the shelving box 101.

Figure 1D:
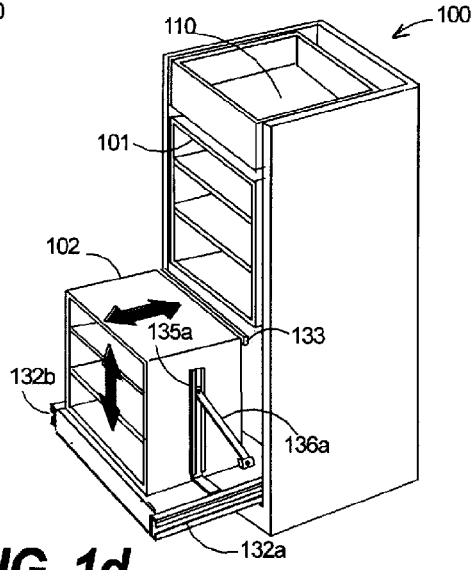
Figure 2A:
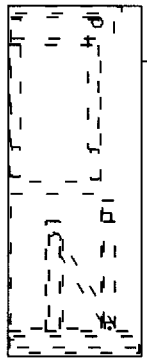
FIGS. 2*a*-2*i* are side views of the present disclosure illustrating the horizontal and vertical interchange of the shelving boxes.
Figure 2B:
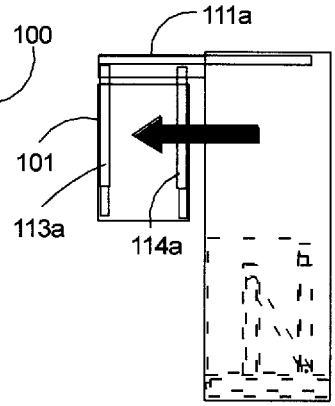
Figure 2C:
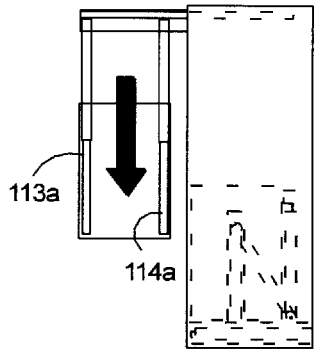
Figure 2D:
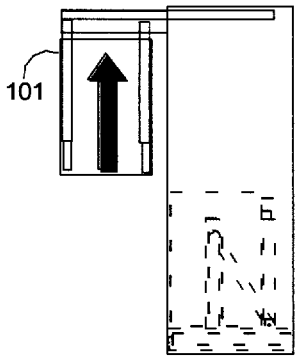
Figure 2E:
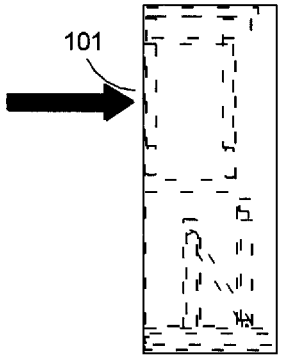
Figure 2F:
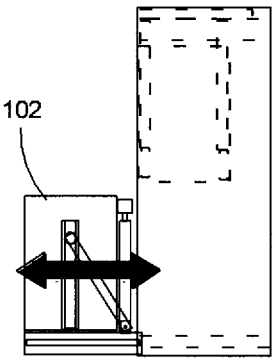
Figure 2G:
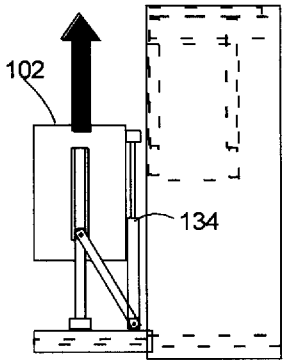
Figure 2H:
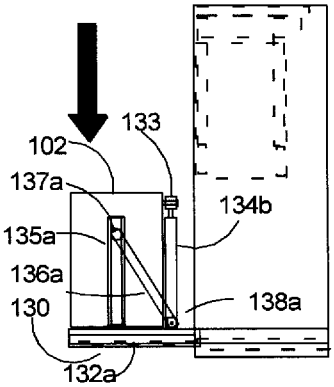
Figure 2I:
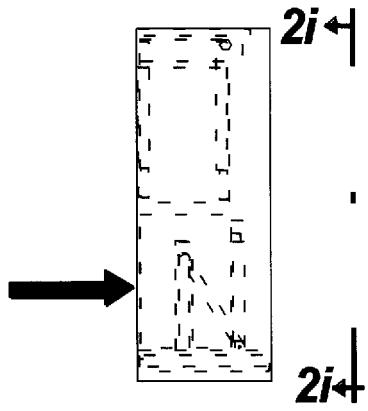
Figure 5A:
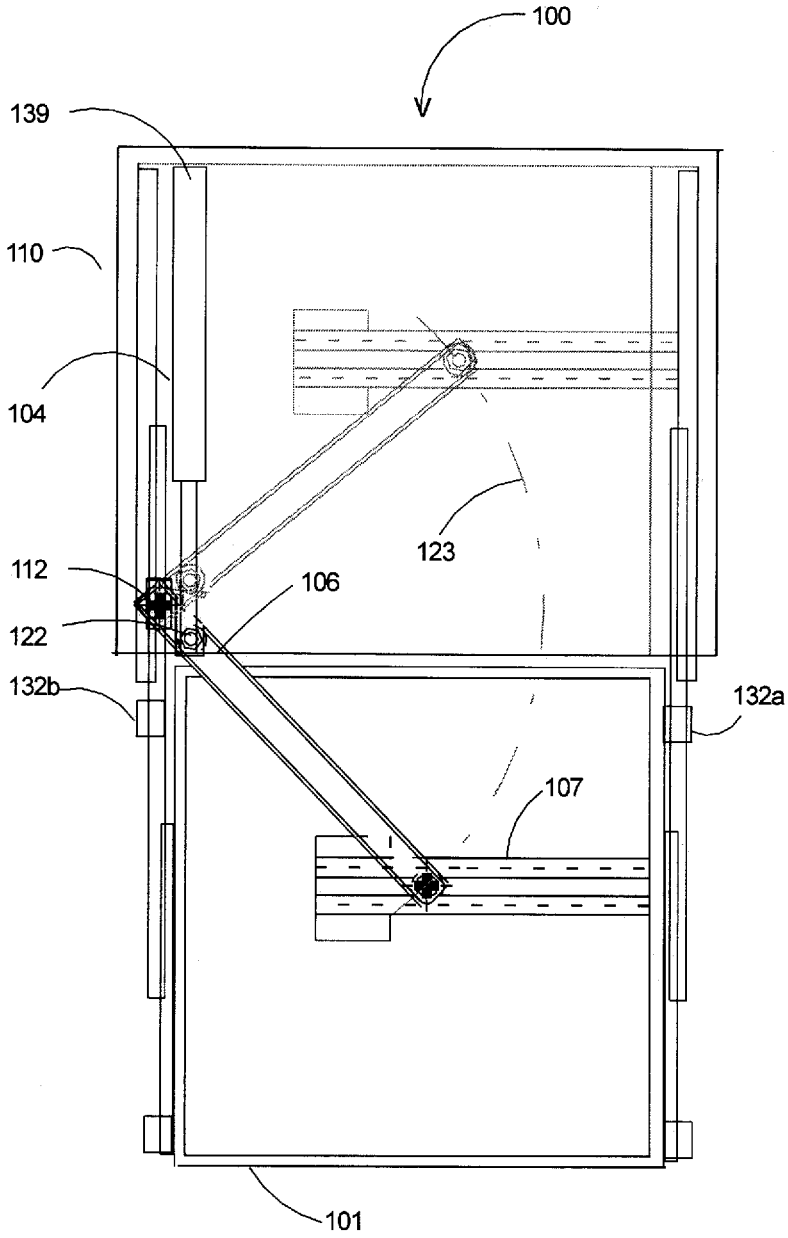
FIG. 5*a* illustrates the operation of the lower motorized platform as shown in FIG. 2*i*, of the present disclosure.

Referring now to FIGS. 1*d*, 2*h*, and 5*a* illustrating a horizontally moveable lower motorized platform 130 supported and fully extendable using horizontal ball slides 132*a* and 132*b* mounted on opposite sides of the lower motorized platform while fixed to the bottommost sides of the VBS. The lower shelving box 102 is moved out of the VBS 100 by the lower motorized platform and vertically positioned upward for shelf access controlled by a person wanting reachable access to an item stored or to be stored on a particular shelf.

FIGS. 2*f*-2*i* and FIG. 5*a* show the coordinated operation of the lower motorized platform 130 with horizontal movement provided by a linear actuator 139 in combination with supporting horizontal slides 132*a*, 132*b*. The linear actuator drives the lower motorized platform while carrying the shelving box from inside the VBS to an outside clearing position, in a similar manner as that described for the upper motorized platform.

Figure 5B:
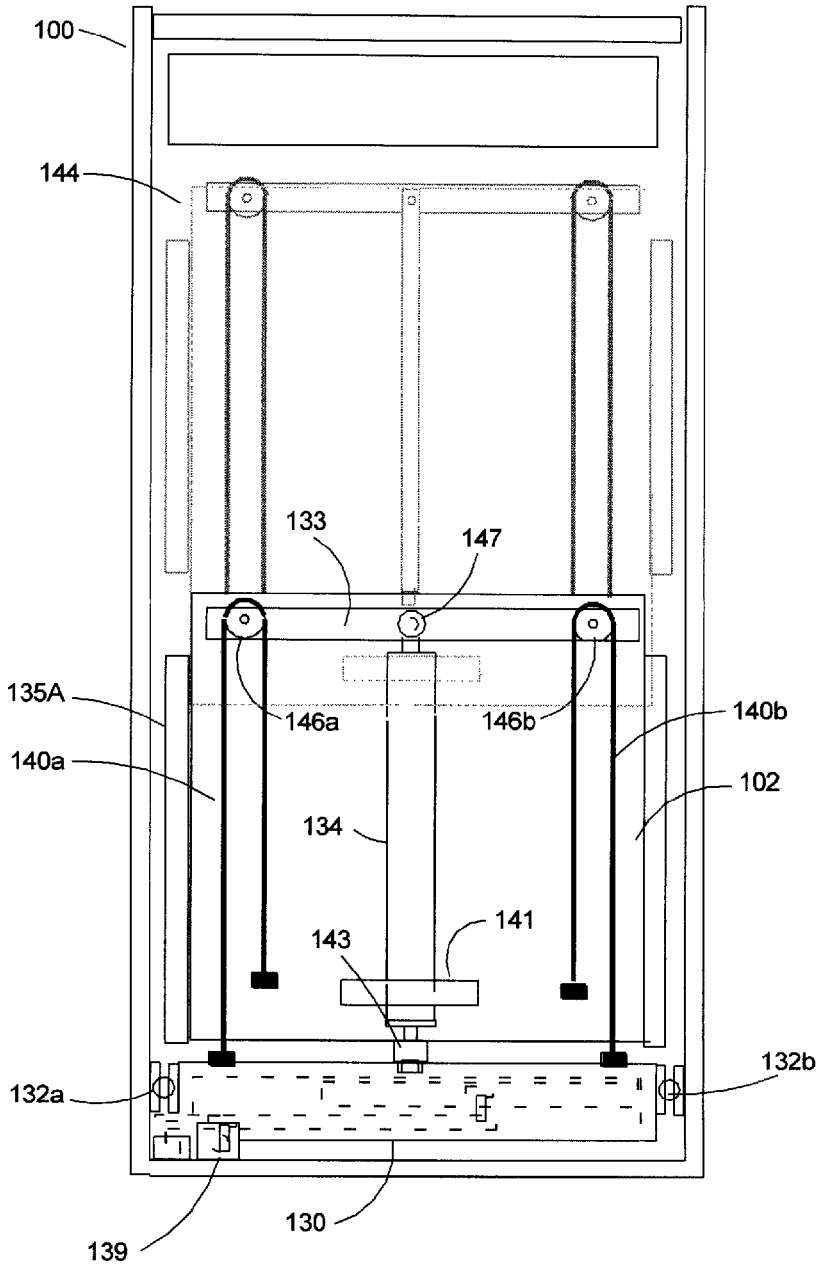
FIG. 5*b* illustrates viewing FIG. 2*h* from the back of the VBS designated by viewing direction arrows 2*i*-2*i*, of the present disclosure.

FIG. 5*b* illustrates vertical linkage 135*a*, 135*b*, 136*a*, 136*b*, 137*a*, 137*b* and 138*a*,138*b*, connecting the lower shelving box with the lower motorized platform 130, to vertically move and adjust the lower shelving box.

Referring now to FIG. 5*b*, showing the stationary member of a linear actuator 139 mounted on the top surface of the bottom member 142 of VBS 100. The moveable member of the linear actuator is attached to the lower motorized platform 130 such that the lower motorized platform can be driven horizontally out of the VBS while carrying the lower shelving box with it. Vertically positioning of the lower shelving box is done with a second linear actuator 134. A stationary end 143 of linear actuator 134 is securely mounted to the top surface of the lower motorized platform 130. The moveable end is attached to a horizontal bar member 133 having pulleys 146*a* and 146*b* mounted at opposite ends of the bar member. Coated stainless steel cables are used as lifting connectors in aiding linear actuator bearing guide 141 to slide upward as the lower shelving box is raised vertically. The coated stainless steel cables 140*a* and 140*b* having one end connected to the top surface of the lower motorized platform 130, the other end connected to the bottom back side of the lower shelving box 102. The routing of the cable pulley system, raises and lowers the lower shelving box 102 at a 2 to 1 ratio to the stroke of the linear motor 134.

Referring also to FIG. 1*d*, having a pair of slideable and extendable channel guides 135*a*, 135*b* (135*b* is mounted on the opposite side of shelving box 102) each having pivoting and extendable members 136*a*,136*b* with a roller bearing attached and placed in the slideable channel guide. The other end is pivotal and attached to the upper surface of the lower motorized platform providing side to side stabilizing of the lower shelving box as it is raised vertically.

Figure 11:
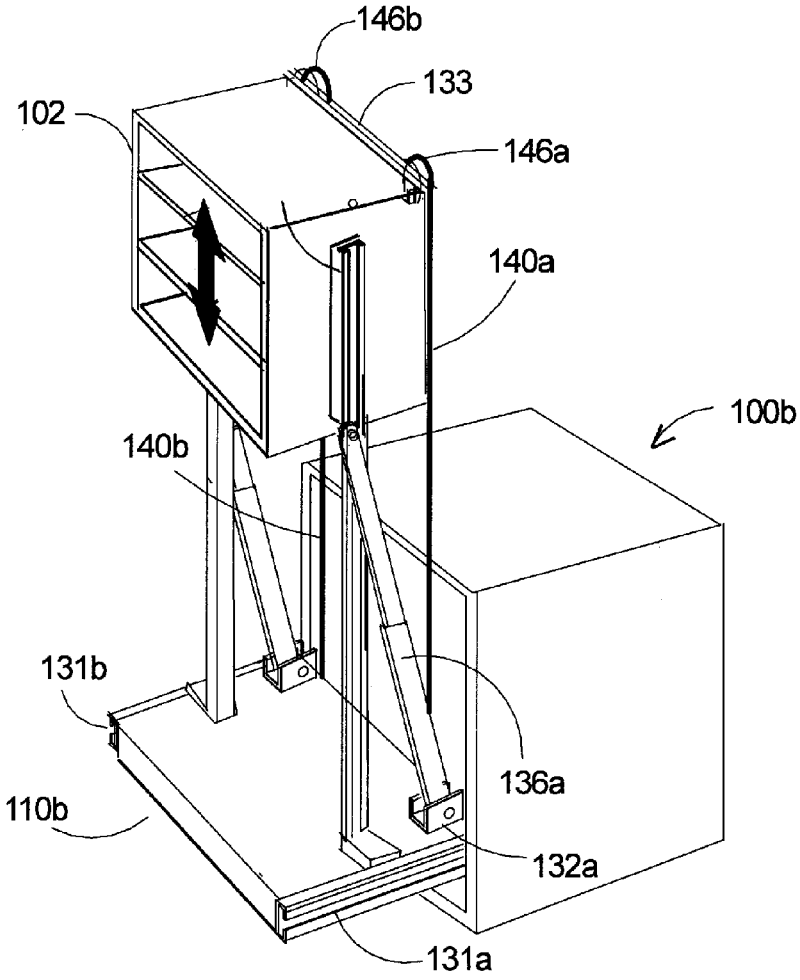
FIG. 11 illustrates a lower box embodiment, of the present disclosure, showing the 2:1 vertical extendability ratio.

FIGS. 6-9 and 11 disclose perspective views of stand-alone examples showing VBSs 100*a* and 100*b* wherein 100*a* is shown as mountable over a counter or work bench and 100*b* positionable under a counter, desk, and workbench or on the floor, each example includes motorized platforms 110*a*, 110*b*, with vertically adjustable shelving boxes 101 and 102. FIG. 11 shows pulleys 146*a* and 146*b* with stainless steel cables 140*a* and 140*b* while illustrating the 2:1 vertical extendability ratio. FIG. 7 shows push button control 126 for vertical adjustment.

While the disclosure has been particularly shown and described with reference to the preferred embodiments thereof, it will be understood by those skilled in the art that various changes in form and details may be made without departing from the spirit and scope of the disclosure.

What is claimed is:

1. An upper vertical box system comprising:

a vertical box structure;

a motorized platform;

said motorized platform horizontally moves a shelving box from inside of said upper vertical box structure to an outside extended position;

wherein said motorized platform is reversibly moved out of and back into said vertical box structure using first and second channel guides, wherein said first channel guide is pivotally mounted to said vertical box structure at one end, and wherein a second end of said first channel guide has a radial bearing placed in said second channel guide that is secured to said motorized platform in a side to side direction, said first channel guide is rotatively driven by a linear actuator having a fixed end attached to said vertical box structure, and a moveable end with a radial bearing placed intermediate said first and second ends of said first channel guide, such that, as said linear actuator extends or retracts, the radial bearing pushes or pulls against a side wall of said first channel guide and rotatively pushes or pulls against said second channel guide thus reversibly moving said motorized platform and said shelving box;

said shelving box is positioned with an open front and at least one shelf;

said shelving box is vertically adjusted while in said outside extended position; and wherein said adjusting is controlled with a push button.

2. The upper vertical box system of claim 1 wherein said motorized platform is slidably attached using ball slides mounted horizontally to each upper side member of said motorized platform and to side members of said vertical box structure.

3. The upper vertical box system of claim 1 wherein said shelving box is vertically moveable using ball slides fixedly mounted to opposite sides of said motorized platform and slidably mounted to corresponding sides of said shelving box.

4. The upper vertical box system of claim 3 wherein said shelving box is vertically moveable using at least two ball slides mounted on each side.

5. The upper vertical box system of claim 1 wherein after said motorized platform and shelving box are extendedly moved out of said upper vertical box structure, a geared motor is signaled to rotate a spooling member such as to controllably lower or to raise said shelving box by means of a cable and pulley arrangement, a first end of said cable fastened to said bottom member of said motorized platform, passing downwards through a first cavity encircling around a first pulley connected to said shelving box and back up through a second cavity and then around a second pulley, on to a third pulley located on the opposite side of said motorized platform, and down thru a third cavity located in the bottom of said motorized platform and around a forth pulley connected to said opposite side of said shelving box and back through a fourth cavity under a fifth pulley wherein the other end of said cable is fastened to said spooling member such as to controllably wind or unwind the cable by said geared motor thus positioning said shelving box for reachable shelves.

* * * * *